US006135274A

United States Patent [19]

James

[11] Patent Number: 6,135,274

[45] Date of Patent: Oct. 24, 2000

[54] DISPOSABLE TOOTHBRUSH

[76] Inventor: Norman James, 1610 Hickory, Mahomet, Ill. 61853

[21] Appl. No.: 09/369,294

[22] Filed: Aug. 6, 1999

[51] Int. Cl.[7] ..... B65D 83/00

[52] U.S. Cl. ..... 206/209.1; 206/362.2; 206/572

[58] Field of Search ..... 206/209.1, 229, 206/361, 362.1, 362.2, 570, 63.5, 572; 132/308; 15/184; 401/132

[56] References Cited

U.S. PATENT DOCUMENTS

| | | | |
|---|---|---|---|
| 3,165,776 | 1/1965 | Tuseth | 401/132 |
| 3,879,139 | 4/1975 | Dahl et al. . | |
| 4,408,920 | 10/1983 | Walther et al. . | |
| 4,530,129 | 7/1985 | Lablick et al. | 15/184 |
| 4,588,089 | 5/1986 | Yanz, Jr. et al. . | |
| 4,880,111 | 11/1989 | Bagwell et al. | 206/209.1 |
| 5,096,321 | 3/1992 | Mountain . | |
| 5,346,061 | 9/1994 | Newman et al. | 206/63.5 |
| 5,378,226 | 1/1995 | Hanifl et al. . | |
| 5,599,126 | 2/1997 | Hough . | |
| 5,755,523 | 5/1998 | Seydel . | |
| 5,915,868 | 6/1999 | Frazell | 401/132 |
| 5,989,205 | 11/1999 | Pond et al. | 206/572 |

*Primary Examiner*—Jim Foster
*Attorney, Agent, or Firm*—Berns Law Office; Michael Berns

[57] ABSTRACT

A portable toothbrush assembly is provided in which a toothbrush and mouth care solution dispenser are sealed within an outer bag. The dispenser preferably is constantly oriented above the bristles of the toothbrush until use. While remaining sealed within the outer bag, the dispenser can be squeezed in order to rupture the dispenser and distribute mouth care solution over the bristles of the toothbrush. The outer bag can then be opened, exposing the toothbrush for use and then, if desired, disposal.

2 Claims, 2 Drawing Sheets

DISPOSABLE TOOTHBRUSH

BACKGROUND OF THE INVENTION

This invention relates generally to the field of dental care, and more particularly to an improved portable toothbrush that can be manufactured economically, kept sanitary, used easily, and disposed of inexpensively.

The advantages of good dental hygiene are well known. Often, however, when one is traveling or away from home, one may forget one's toothbrush. Hotels, health care facilities, nursing homes, hospitals, daycare facilities, schools and the like have a need for a self-contained portable toothbrush system that is economical to manufacture and thus economical to use; and later discard, and a similar need exists for a toothbrush system that can remain sanitary or even sterile before the use of the system. Such an invention could be used in vending machines, or distributed in large quantities for simple, portable use from anywhere. Prior art toothbrush systems have attempted to meet some of these needs by providing toothbrushes typically with toothpaste contained within the toothbrush itself, through an integrated channel, for distribution through the toothbrush and around the bristles. This approach can be less economical than the present invention due to the added manufacturing costs of toothbrushes with integrated channels. In addition, the toothpaste in some of these prior art toothbrushes, not being properly sealed, has a tendency to become dry, hard and stale. Other prior art devices are more difficult to use than the present invention. There is a need in the art for an improved, simple, yet economical toothbrush that can be easily stored, used, and disposed of inexpensively.

It is an object of the present invention to produce a toothbrush that is simple to use, one that is economical to produce and use, and one that can remain sanitary or sterile until use. It is a further object of the present invention to produce a toothbrush system that is portable, hygienic, and economical for purchase and use.

SUMMARY OF THE INVENTION

These and other objects and needs are met by the present invention, a portable toothbrush system which, in one form of the invention, comprises an outer bag, a toothbrush, a mouth care solution, and a dispenser. The toothbrush comprises a handle member, a toothbrush head member which is coupled to the toothbrush handle member and having an upper surface, and a plurality of bristle members coupled to and extending perpendicularly outward from the upper surface of the toothbrush head member, the plurality of bristle members having a top surface. The dispenser and toothbrush are sealed within the outer bag, with the mouth care solution being contained within the dispenser. The dispenser is configured to rupture and dispense the mouth care solution onto the plurality of bristle members when the dispenser is squeezed, during which the dispenser is contained within the outer bag. Preferably, the toothbrush is sealed within the outer bag so that the toothbrush could not fully rotate within the outer bag, in order to keep the toothbrush in substantially the same position and the bristles in substantially the same orientation relative to the inside of the bag. Preferably, the dispenser is sealed within the outer bag so that the dispenser will remain between the top surface of the plurality of bristle members and the inner surface of the outer bag. When the bristles are maintained in a relatively stationary orientation within the outer bag and the dispenser remains above the bristles, it is even simpler to squeeze the dispenser and cause the mouth care product to be distributed directly onto the bristles of the toothbrush. Preferably, the mouth care product is a dentifrice. The dispenser, in a preferred embodiment, is a breakable pouch, and preferably comprises a plastic pouch, which forms a cavity holding the mouth care solution and also comprises a breakable seal, which seals the mouth care solution within the dispenser and which is configured to be ruptured as the dispenser is squeezed.

The sealing of the mouth care solution, first within the dispenser, and secondly within the outer bag, provides for a more sanitary, fresher mouth care solution. Because the dispenser and toothbrush can be simply manufactured, partly because the mouth care solution is not contained within the toothbrush itself, the toothbrush system is more inexpensive to manufacture, and thus it is also more economical to dispose of the system. The outer bag can be used to seal the toothbrush system, allowing sanitary, or even sterile, transportation and storage. Preferably, the outer bag is transparent for easier orientation of the bristle members with the dispenser.

Other objects, advantages, and novel features of the invention will become apparent from the following detailed description and appended claims, when taken in conjunction with the accompanying drawings.

REFERENCE NUMERALS IN THE DRAWINGS

Figure 1:
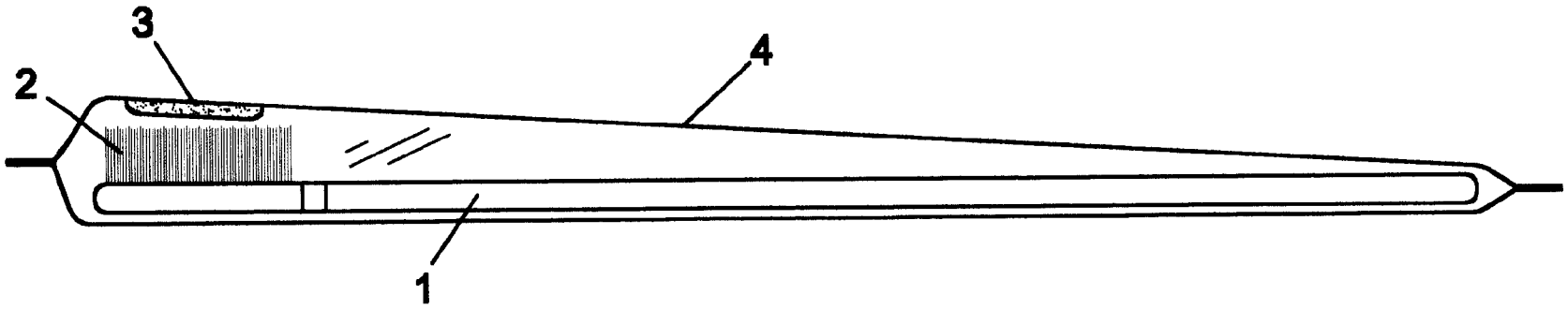
FIG. 1 is a side elevational view of one embodiment of the invention.
Figure 2:
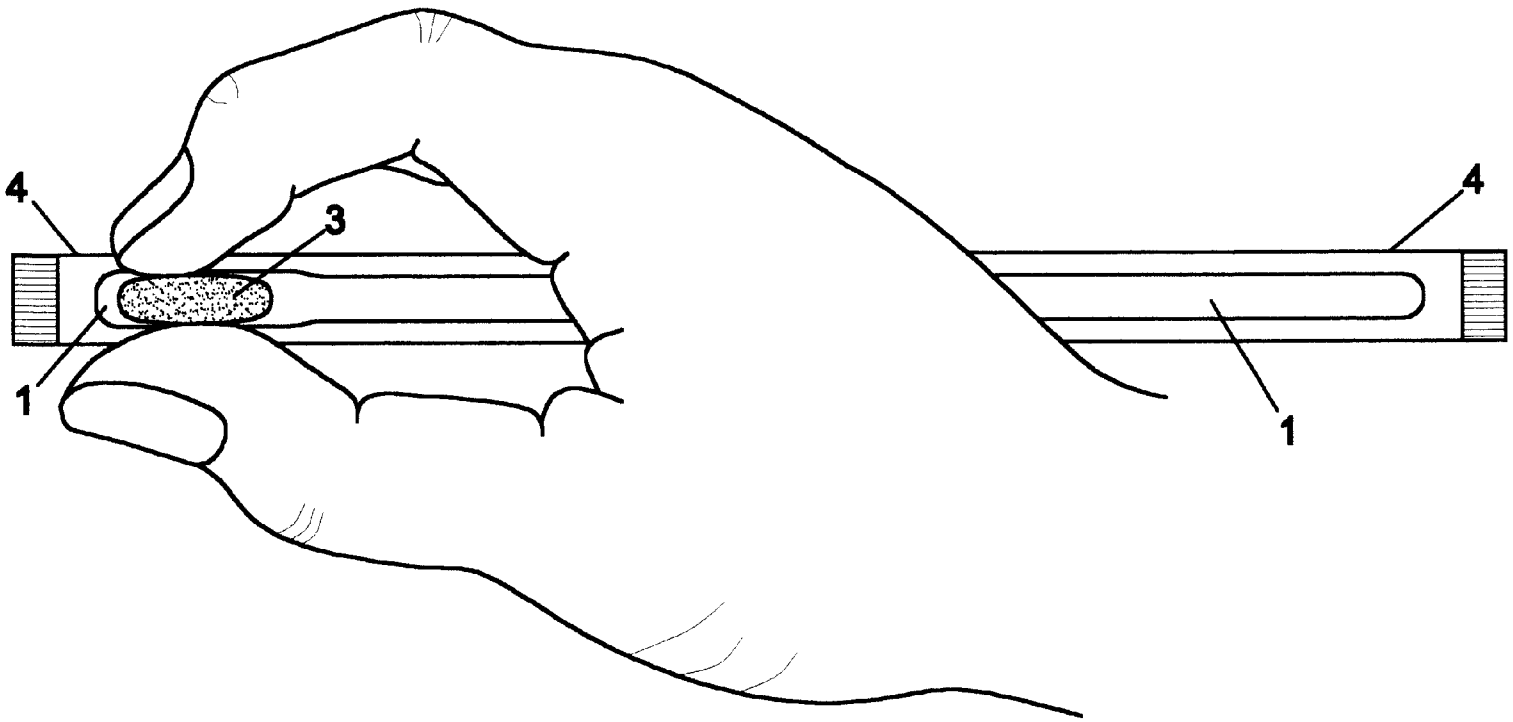
FIG. 2 is a top plan view of one embodiment of the invention in use.

1. toothbrush
2. toothbrush handle portion
3. toothbrush head portion
4. bristles
5. outer bag
6. dispenser
7. mouth care solution

DETAILED DESCRIPTION OF THE PREFERRED EMBODIMENT

FIG. 1 is a side elevational view of one embodiment of the invention. A toothbrush 1 as part of the portable toothbrush assembly is comprised of a toothbrush handle portion 2, a toothbrush head portion 3 which is coupled to the toothbrush handle portion 2, and a plurality of bristle members 4, which protrude perpendicularly upward from the upper surface of the toothbrush head portion 3. The toothbrush handle portion 2 can be, but need not be, substantially rectangular in shape and substantially longitudinal, and the handle can be constructed of wood, acrylic, or a plastic, such as polyethylene, polypropylene, or any number of others. Preferably, the handle is made from a material that allows for economic manufacture. If desired, the head portion 3 may be wider than the handle portion 2 for a more constricted fit within an outer bag 5. The bristle members 4 can be made of plastic, such as polyethylene, polypropylene, or any number of other plastics. The preferably simple and economical design of the toothbrush 1 in the present invention allows for more economical and inexpensive manufacturing of the system, thereby allowing the more economical disposing of the system after use.

A dispenser 6 is provided to hold and apply a mouth care solution 7 onto the bristles 4 of the toothbrush 1. The mouth care solution 7 is generally a toothpaste, gel, or similar dentifrice or oral hygiene product, as necessary. The dispenser 6, preferably a frangible pouch capsule, or packet, may be formed of plastic, such as polyethylene, or any plastic or material that is non-reactive with the mouth care solution 7. The mouth care solution 7 will remain in the dispenser 6 until the toothbrush 1 is ready for use. Preferably, the dispenser 6 is fully sealed, helping the mouth care solution 7 to remain fresh until use. The dispenser 6 must be configured to break and release mouth care solution when adequate pressure is applied to the dispenser 6, preferably by a user squeezing the dispenser with the user's fingers, such as the thumb and forefinger. The dispenser 6 can be perforated, can contain a line of weakening, or the dispenser can be composed of an easily rupturable material. Other methods of making the dispenser rupturable under pressure may be used.

A dispenser 6 may be provided similar to a blister pack used to dispense individual medicines. Once ruptured, the dispenser 6 then will have an opening so that continued squeezing will dispense the mouth care solution 7 onto the top surface of the bristle members 4. Air may be placed into the dispenser 6 along with the mouth care solution 7 to aid the dispenser 6 in bursting without undesirable distribution of the mouth care solution 7. Select sections within the dispenser 6 can be configured to rupture more easily than others, allowing for a more controlled flow and distribution of the mouth care solution 7.

Both the toothbrush 1 and the dispenser 6 are sealed within an enclosed outer bag 5. In one embodiment, the outer bag 5 is used to coincidentally form the non-breakable portion of the dispenser 6, or the dispenser 6 may be otherwise integrated within the outer bag 5. The outer bag 5 is designed to be sealed to allow the toothbrush assembly 1 to remain sanitary, or even sterile, as it is stored, transported, or distributed. The outer bag 5 may be heat sealed around the periphery of the bag. This sealed bag, along with the simple and inexpensive design of the toothbrush itself, makes the system most desirable for one-time, sanitary use. The outer bag 5 preferably is made of a plastic material, such as polyethylene, and preferably is transparent to allow easy orientation of the dispenser 6 with the bristle members 4. Preferably, the outer bag 5 is sealed around the toothbrush 1 and dispenser 6 so that the toothbrush would not be able to fully rotate within the outer bag 5, thus maintaining a substantially consistent orientation of the bristle members 4 with the inner surface of the outer bag 5. This could be accomplished by constricting the outer bag 5, especially about the head portion 3, bristle members 4, and dispenser 6. Preferably, the dispenser 6 is sealed within the outer bag 5 so that the dispenser 6 remains oriented between the top surface of the bristle members 4 and the inside surface of the outer bag 5. In this way, the dispenser 6 remains over the bristle members 4 so that the user would not have to move the dispenser along the outer bag 5 and orient the dispenser 6 before squeezing and dispensing mouth care solution 7. In one embodiment of the invention, a securing wrap may be used to maintain the orientation of the dispenser 6 in direct proximity to the top surface of the bristle members 4. Other means for securing the dispenser 6 to the top surface of the bristle members 4 may be used.

In use, the rupturable dispenser 6 would be squeezed or otherwise subjected to pressure while the toothbrush 1 remained sealed within the outer bag 5, therefore allowing optimally sanitary use of the toothbrush assembly. A substantially constant orientation of the dispenser 6 with respect to the bristle members 4 of the toothbrush 1, combined with a transparent outer bag 5, will allow a user to easily dispense the mouth care solution 7 over the bristle members 4 by squeezing the dispenser 6. Also, since the dispenser 6 is oriented above the bristle members 4, unlike some prior art toothbrushes, the mouth care solution 7 is more likely to be distributed over the tips of the bristle members 4, which is desirable, instead of undesirably being distributed down between the bristle members 4. Once the mouth care solution 7 has been dispensed onto the bristle members 4, the user can then open the outer bag 5 and remove the toothbrush 1, having a mouth care solution 7 applied. The outer bag 5 preferably is configured so that it may be opened easily and without substantially interfering with the dispensed mouth care solution 7. Weakened areas, opening strips, or jagged edges are possibilities, along with other options. After the user has used the toothbrush 1, one may, but not necessarily, then easily and economically dispose of the system.

The foregoing description of a preferred embodiment of the invention has been presented for purposes of illustration and description, and is not intended to be exhaustive or to limit the invention to the precise form disclosed. The description was selected to best explain the principles of the invention and practical application of these principals to enable others skilled in the art to best utilize the invention in various embodiments and various modifications as are suited to the particular use contemplated. It is intended that the scope of the invention not be limited by the specification, but be defined by the claims set forth below.

I claim:

1. An apparatus for brushing teeth, the apparatus comprising:

a) an outer bag having an inner surface;

b) a toothbrush, the toothbrush comprising: a handle member; a toothbrush head member coupled to the toothbrush handle member, the toothbrush head member having an upper surface; and a plurality of bristle members coupled to and extending perpendicularly outward from the upper surface of the toothbrush head member, the plurality of bristle members having a top surface, the toothbrush being sealed within the outer bag such that the toothbrush cannot fully rotate within the outer bag;

c) a mouth care solution; and d) a dispenser, the dispenser being sealed within the outer bag, the mouth care solution being contained within the dispenser, the dispenser being configured to rupture and dispense the mouth care solution onto the plurality of bristle members when the dispenser is squeezed while the dispenser is sealed within the outer bag.

2. The apparatus of claim 1, wherein the dispenser is sealed within the outer bag such that the dispenser remains located between the top surface of the plurality of bristle members and the inner surface of the outer bag.

* * * * *